US007914176B2

(12) United States Patent
Stanley et al.

(10) Patent No.: US 7,914,176 B2
(45) Date of Patent: Mar. 29, 2011

(54) LINEAR LIGHT FIXTURE

(75) Inventors: John Stanley, Racine, WI (US); Don Miletich, Franklin, WI (US); Wayne Guillien, Franksville, WI (US)

(73) Assignee: Ruud Lighting, Inc., Racine, WI (US)

( * ) Notice: Subject to any disclaimer, the term of this patent is extended or adjusted under 35 U.S.C. 154(b) by 583 days.

(21) Appl. No.: 11/941,634

(22) Filed: Nov. 16, 2007

(65) Prior Publication Data

US 2009/0129071 A1 May 21, 2009

(51) Int. Cl.
*F21V 19/02* (2006.01)

(52) U.S. Cl. ..... 362/285; 362/217.11; 362/217.12; 362/217.13; 362/217.14; 362/217.15; 362/217.16; 362/217.17; 362/418; 362/427

(58) Field of Classification Search ..... 362/220, 362/285, 418, 427, 217.01, 217.08, 217.1, 362/217.11–217.17, 235, 249.02, 282
See application file for complete search history.

(56) References Cited

U.S. PATENT DOCUMENTS

| | | | | |
|---|---|---|---|---|
| 6,039,597 | A * | 3/2000 | Getselis et al. | 439/441 |
| 6,102,550 | A * | 8/2000 | Edwards, Jr. | 362/221 |
| 7,131,753 | B1 * | 11/2006 | Edwards, Jr. | 362/405 |
| 2004/0151002 | A1 * | 8/2004 | Garber et al. | 362/405 |
| 2005/0248937 | A1 * | 11/2005 | Kain et al. | 362/217 |

* cited by examiner

*Primary Examiner* — Sandra L O Shea
*Assistant Examiner* — Mary Zettl
(74) *Attorney, Agent, or Firm* — Jansson Shupe & Munger Ltd.

(57) ABSTRACT

In a first embodiment the invention is for use with a light-fixture assembly for elongate light tubes of the type that includes (a) an elongate support frame and (b) a cross-structure at each of the opposite ends thereof and has at least one lamp holder thereon. The improvement of the embodiment wherein the cross-structures each include at least one folding arm movable between a stowed position substantially parallel with the support frame and a deployed position substantially perpendicular to the support frame.

15 Claims, 7 Drawing Sheets

LINEAR LIGHT FIXTURE

FIELD OF THE INVENTION

This invention relates to lighting fixtures and, more particularly, to lighting fixtures using elongate light tubes.

BACKGROUND OF THE INVENTION

Lighting fixtures utilizing elongate light tubes are well known in the art and are utilized in many different lighting applications. In most cases these fixtures are large and bulky. A typical fixture includes a length that is slightly longer than the length of the tube to be utilized and a width that is dependent upon many variables. These variables include the number of tubes to be employed, the width and number of the reflectors to be used, and any additional features such as a housing to protect the fixture.

The use of a fixture with a housing leads to a fixture that is bulky and difficult to move but one that does provide some protection against breakage of the internal portions of the fixture during shipping. However, many fixtures for use in industrial settings utilize exposed supports and reflectors that leave open a large potential for breakage during the shipping process. The exposed supports and reflectors are generally quite fragile and not designed to accept loads or impacts without damage.

Furthermore, both types of fixtures present a large object to ship to the location where they are to be installed. Large boxes or other packaging for such transport is expensive to ship and takes up substantial room.

OBJECTS OF THE INVENTION

It is an object of the invention to provide an improved linear light fixture that overcomes some of the problems and shortcomings of the prior art, including those referred to above.

Another object of the invention is to provide an improved linear light fixture that allows the fixture to be packed in smaller packaging.

Another object of the invention is to provide an improved linear light fixture that is easy to assemble on the sight where it is to be installed.

Another object of the invention is to provide an improved linear light fixture that includes support arms that lock securely into place when deployed.

How these and other objects are accomplished will become apparent from the following descriptions and the drawings.

SUMMARY OF THE INVENTION

In a first embodiment the invention is for use with a light-fixture assembly for elongate light tubes of the type that includes (a) an elongate support frame and (b) a cross-structure at each of the opposite ends thereof and has at least one lamp holder thereon. The improvement of the embodiment is that the cross-structures each include at least one folding arm movable between a stowed position substantially parallel with the support frame and a deployed position substantially perpendicular to the support frame.

In a second embodiment the light fixture assembly further includes at least one elongate reflector removably attached to both cross-structures when the cross-structures are in the deployed position.

In a third embodiment of the light fixture assembly the cross-structures further include a mounting bracket, wherein the mounting bracket is attached to the support frame and the folding arm is movably attached to the mounting bracket.

In another embodiment the light fixture assembly further includes a locking mechanism for locking the folding arms into the stowed position.

In a further embodiment of the light fixture assembly the locking mechanism includes a hole defined on the mounting bracket and a locking ramp extending from the folding arm disposed and sized to fit within the hole when the folding arm is in the stowed position.

In yet another embodiment of the light fixture assembly each cross-structure includes two folding arms, whereby the folding arms of each cross-structure extend from opposite sides of the support frame.

In a still further embodiment the light fixture assembly further includes at least one elongate reflector attached to the folding arms extending from each side of the support frame. In other embodiments the folding arm includes at least two lamp holders.

In another embodiment of the light fixture assembly each cross-structure includes at least one screw for attaching the elongate reflector and the elongate reflector includes at least one keyhole-type opening for accepting the screw, thereby allowing for removable attachment of the reflector to the cross-structure.

In other embodiments a light-fixture assembly for elongate light tubes of the type including an elongate support frame includes an improvement having at least one cross-structure attached to the frame and having at least one folding arm movable between a stowed position substantially parallel with the support frame and a deployed position substantially perpendicular to the support frame.

In some embodiments the light fixture assembly further includes two cross-structures attached to the frame. Each of these cross structures has at least one folding arm that is movable between a stowed position substantially parallel with the support frame and a deployed position substantially perpendicular to the support frame. The folding arm of each of the two cross-structures is disposed to extend from a first side of the frame. In a further modification the folding arms extending from the cross-structures comprise a first folding arm assembly and the light fixture assembly further including a second folding arm assembly attached to cross-structures wherein the folding arms of the second folding arm assembly are disposed to extend from a second side of the frame. It is preferable that the cross-structures are disposed at opposite ends of the elongate support frame. Furthermore, the light fixture assembly could include a plurality of reflectors attached to each of the folding arm assemblies.

A further embodiment of the invention includes a method of utilizing a light fixture assembly. In this method, an elongate light fixture support assembly having a width is provided along with a pair of cross-structures, the cross-structures each having at least one lamp holder. The support assembly and the cross-structures are packaged together such that the cross-structures extend away from the support assembly less than one-half of width of the support assembly. The packaged device is shipped a location where it is to be installed and the cross-structures are deployed whereby the lamp holders are positioned to receive an elongate light bulb. In other embodiments of the method the cross-structures include at least one folding arm movable between a stowed position substantially parallel with the support frame and a deployed position substantially perpendicular to the support frame. In such an embodiment, during the step of packaging the at least one folding arm is in the stowed position and during the step of deploying the at least one folding arm is moved into the deployed position. In another embodiment this method also includes prior to the step of packaging, providing at least one elongate reflector. Then the step of packaging also includes packaging the reflector together with the support assembly and cross-structure such that the cross-structures and at least one reflector extend away from the support assembly less than one-half of width of the support assembly. Finally, after the step of deploying the cross-structures, attaching the at least one reflector to the folding arms of the cross-structures.

DETAILED DESCRIPTION OF PREFERRED EMBODIMENTS

Figure 1:
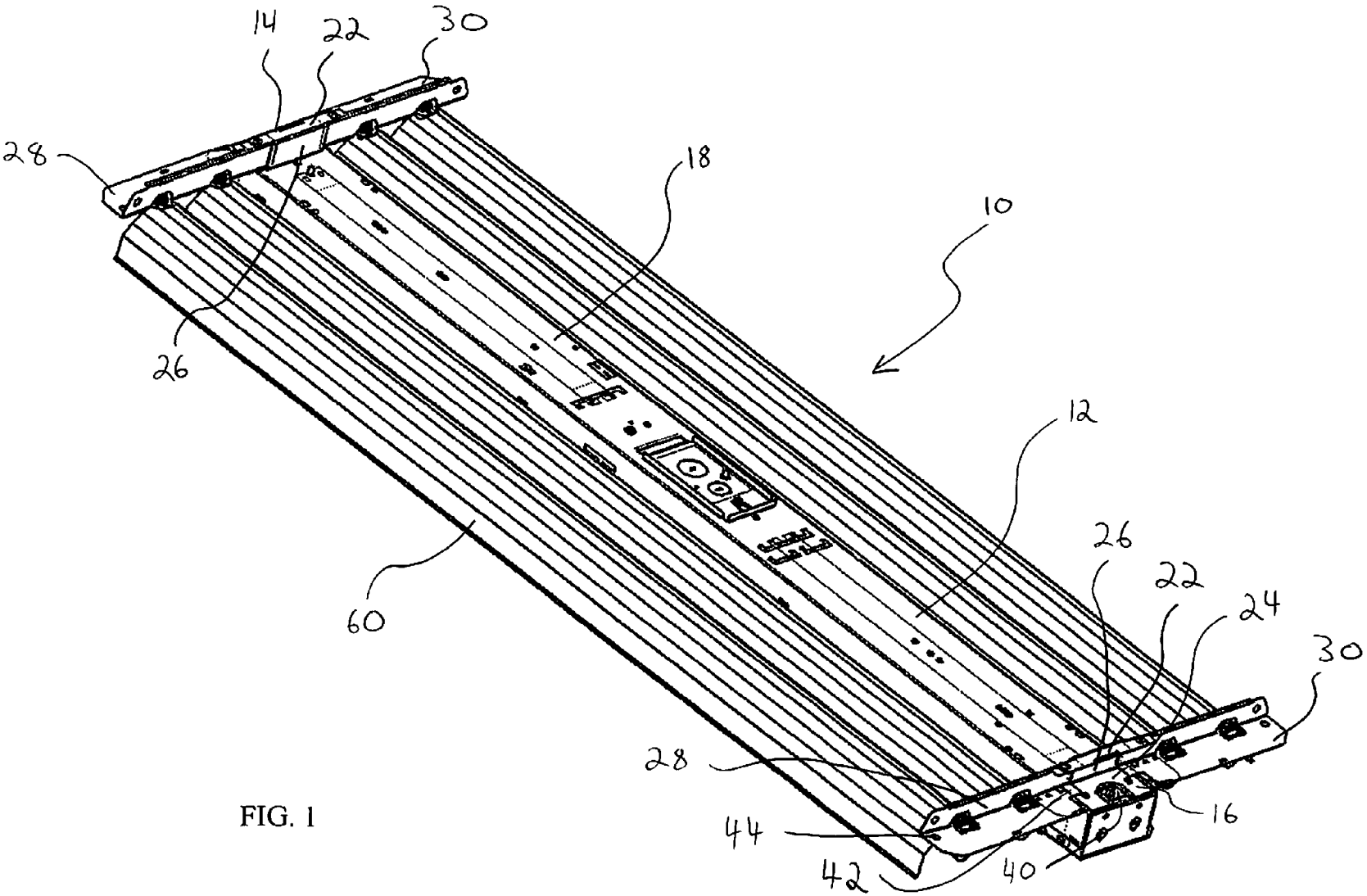
FIG. 1 is a top perspective view of a light fixture assembly in accordance with this invention.
Figure 2:
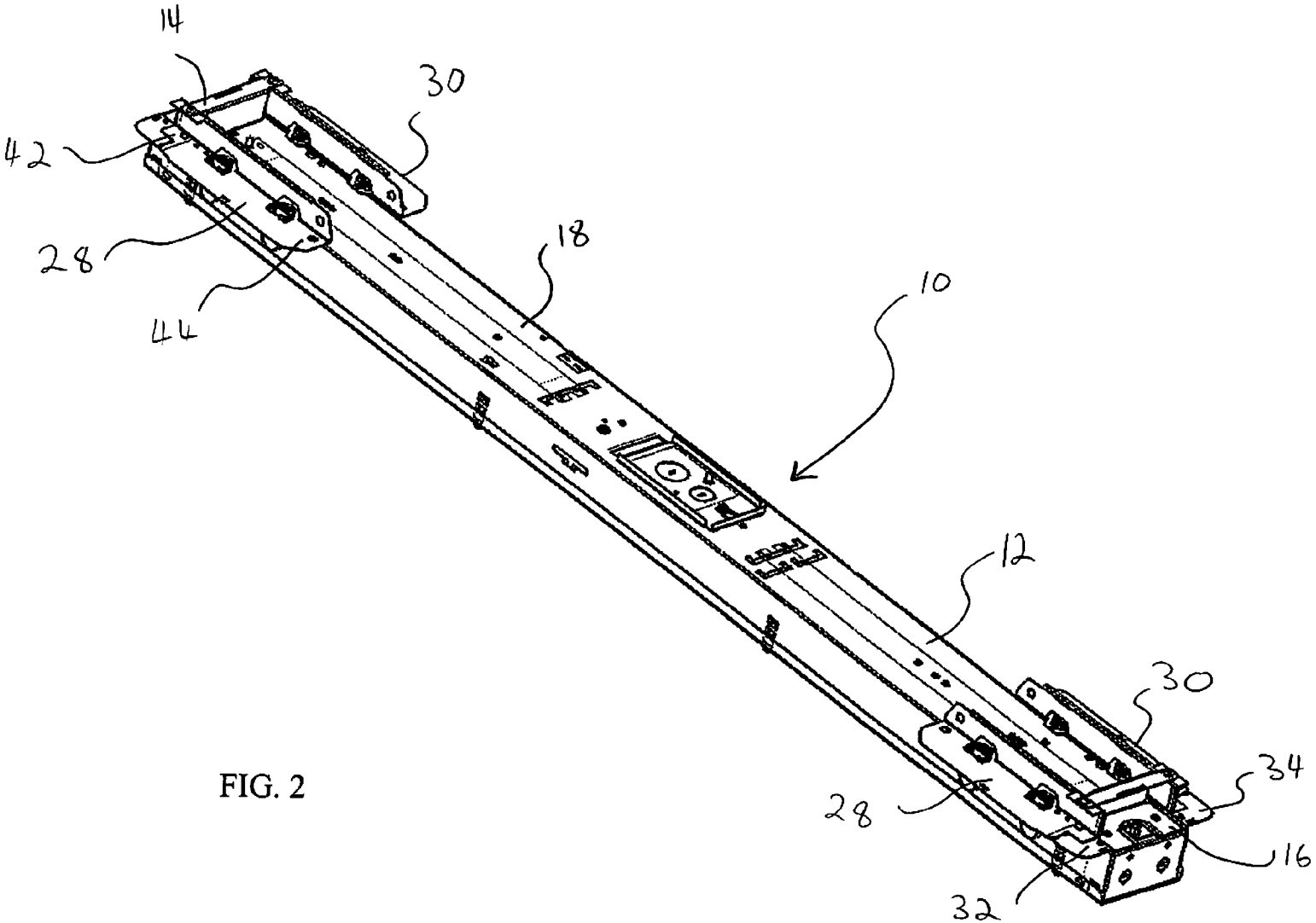
FIG. 2 is a top perspective view of the light fixture assembly of FIG. 1 without reflectors and the folding arms in the stowed position.
Figure 3:
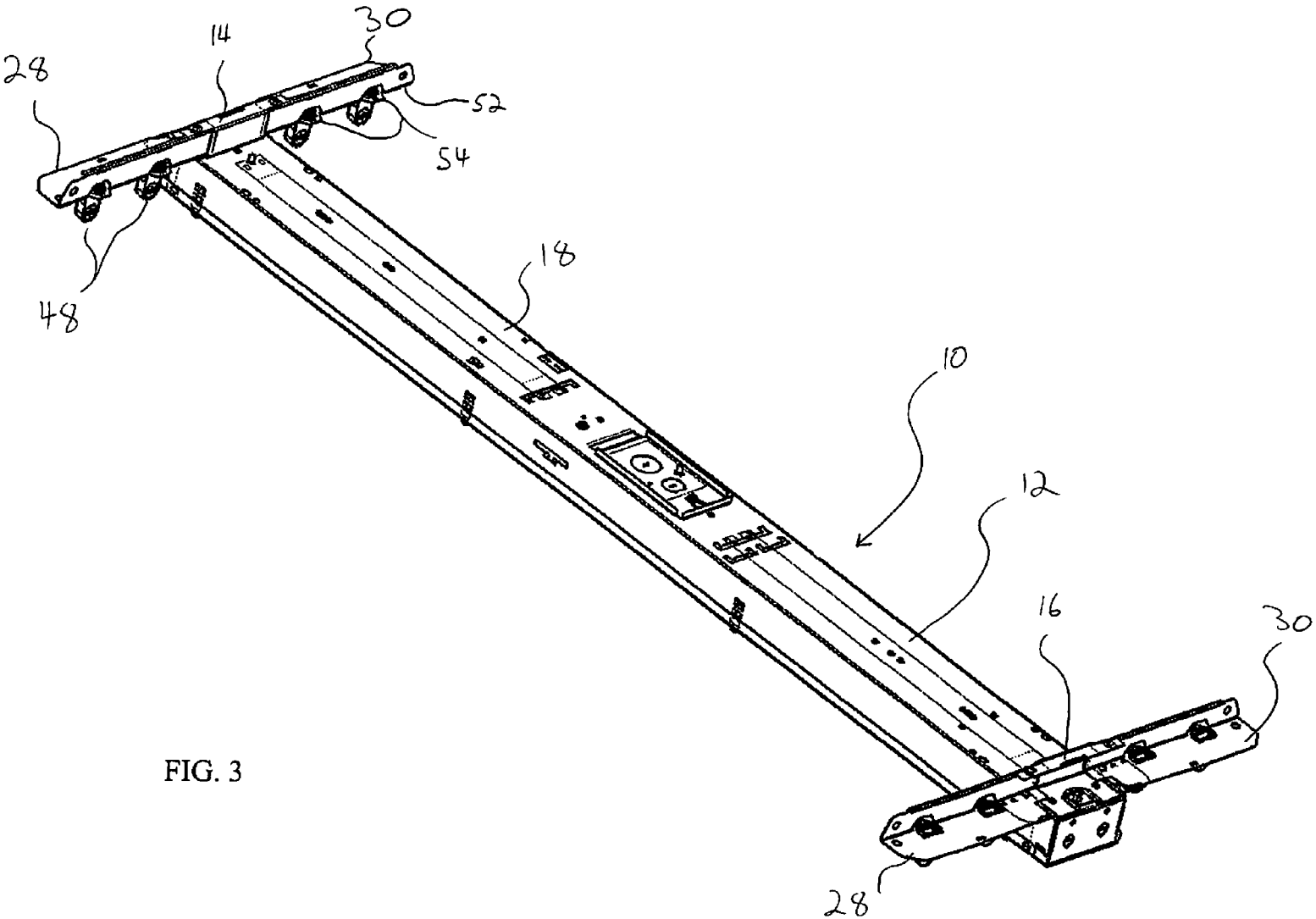
FIG. 3 is a top perspective view of the light fixture of FIG. 2 with the folding arms in the deployed position.
Figure 4:
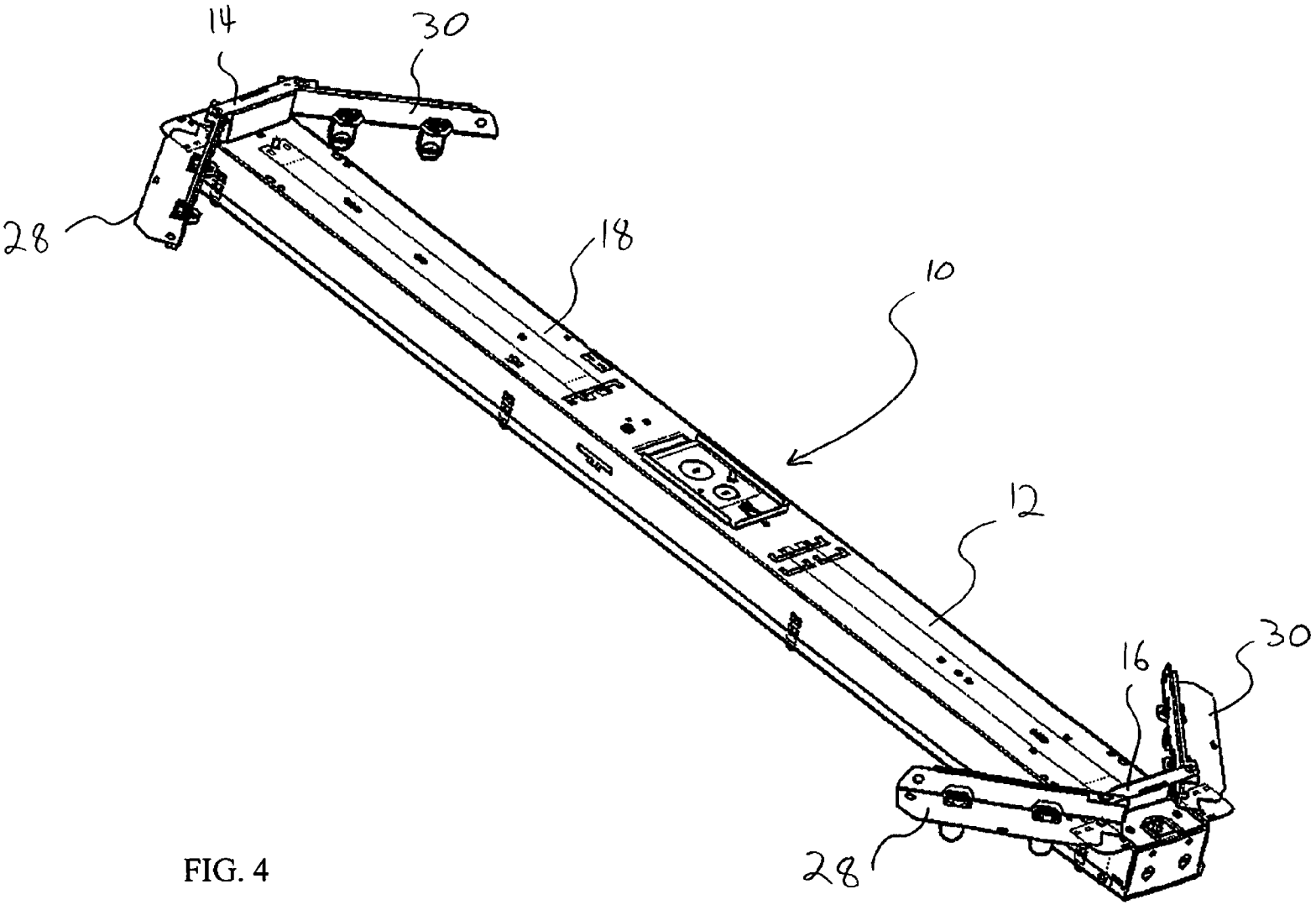
FIG. 4 is a top perspective view of the light fixture of FIG. 2 with the folding arms between the deployed and stowed positions.
Figure 5:
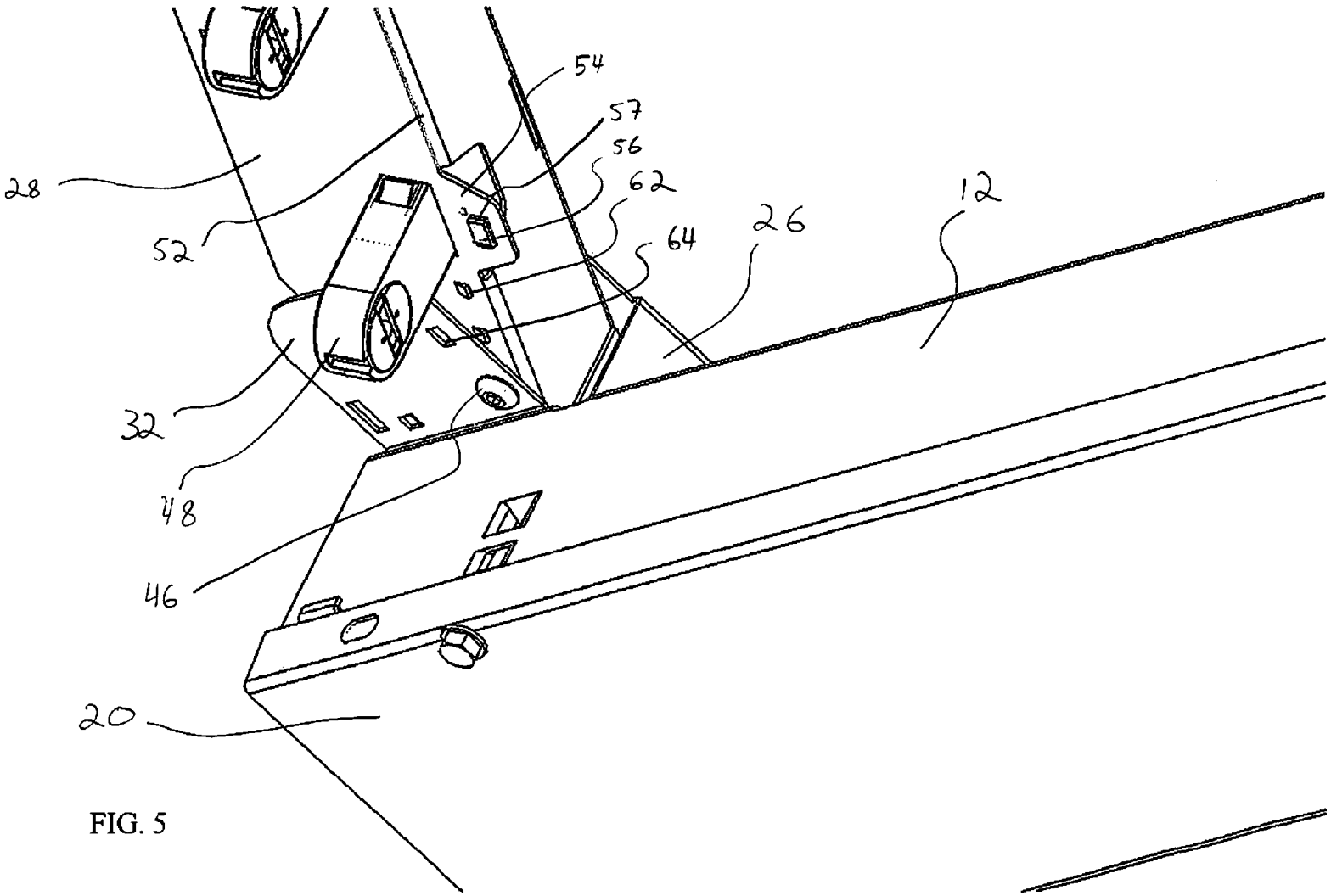
FIG. 5 is an enlarged fragmentary view of the cross-structure and folding arm assembly with the folding arm between the deployed and stowed positions.
Figure 6:
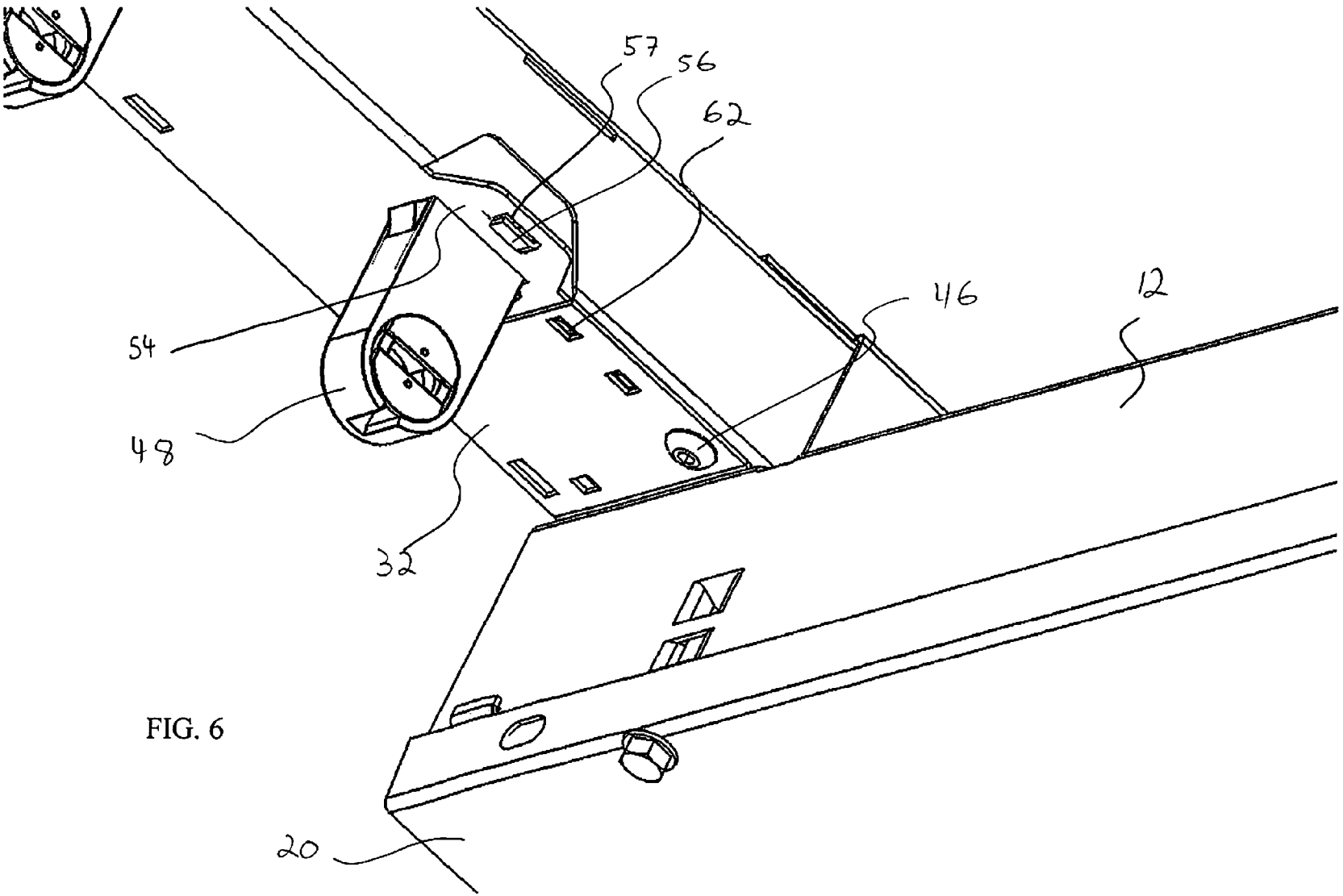
FIG. 6 is an enlarged fragmentary view of the cross-structure and folding arm assembly with the folding arm in the deployed position.
Figure 7:
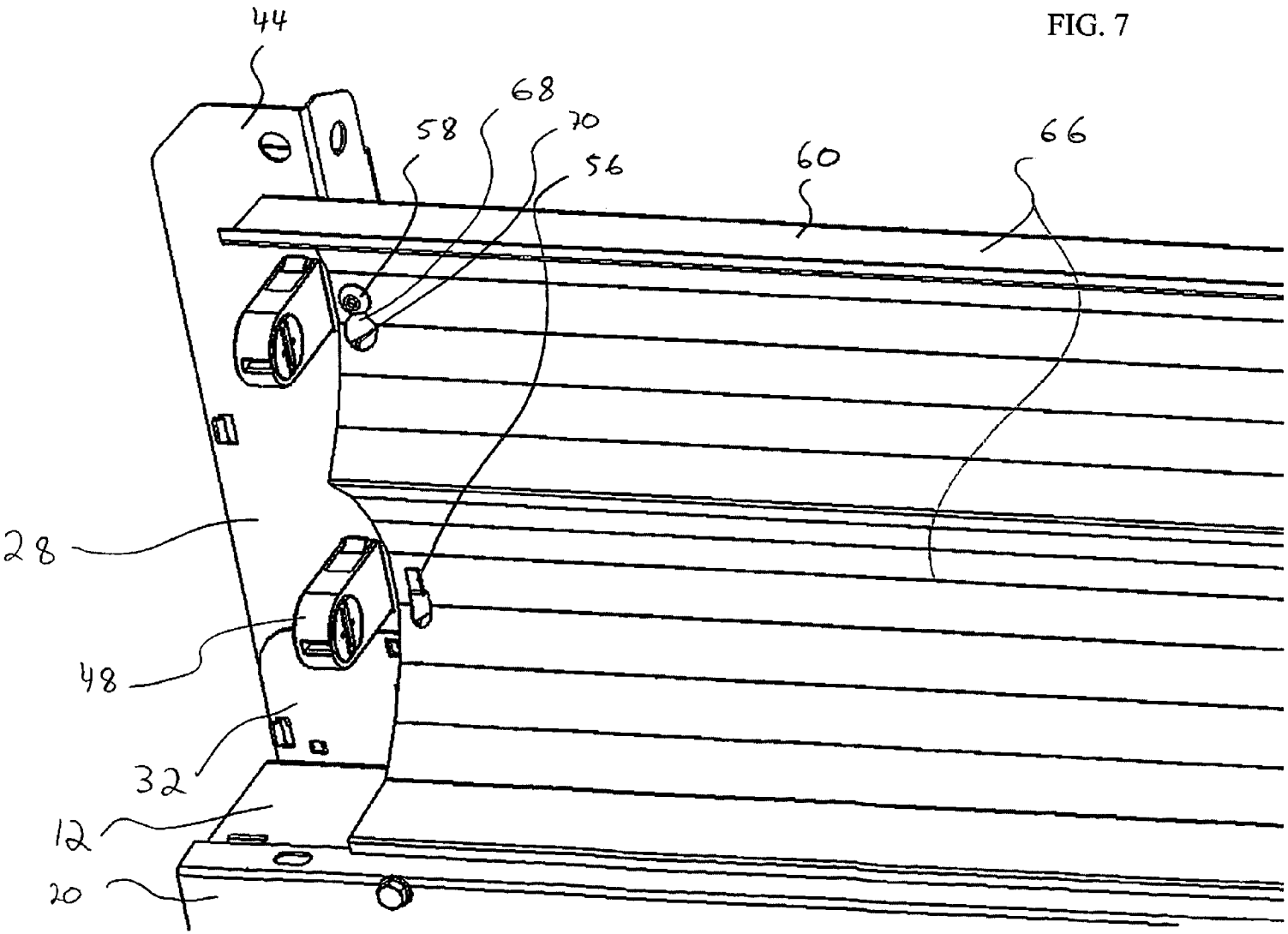
FIG. 7 is an enlarged fragmentary view of the cross-structure and folding arm assembly with the folding arm in the deployed position and including reflectors.

Referring now to FIGS. 1-7 a first preferred embodiment of a light fixture assembly 10 according to the present invention is shown. The assembly 10 includes an elongate support frame 12 and first and second cross-structures 14, 16 at opposite ends of the assembly 10. However, other embodiments could include only one cross-structure mounted, for example, in the middle of the support frame.

The support frame 12 includes a top surface 18 and a bottom surface 20 between which an interior is formed. The interior of the support frame 12 can house the internals of the light fixture such as a ballast. Each of the cross-structures 14, 16 include a mounting bracket 22 that is mounted to the top 18 of the support frame 12 at opposite ends and a pair of folding arms 28, 30 moveably attached to the mounting bracket. In this preferred embodiment, the mounting bracket 22 is generally L-shaped with a lower part 24 of the L-shape mounted to the support frame 12 and the upper part 26 of the L-shape perpendicular to the length of the support frame 12. Additionally the mounting bracket 22 and the support frame 12 define an opening 40 that allows wiring (not shown) to pass into the interior of the support frame 12.

The lower part 24 of the mounting bracket 22 includes opposite support flanges 32, 34 that overhang the support frame 12. The upper part 26 of the mounting bracket 22 includes a top flange 36 that is substantially perpendicular to the upper part 26 and extending therefrom. Top flange 36 and the lower part 24 of the mounting bracket 22 define a channel 38 for mounting the folding arms 28, 30.

Each of the folding arms 28, 30 includes a pivot end 42 and a free end 44. As seen best in FIGS. 5-7, the pivot end 42 is attached to the mounting bracket 22 at pivot point 46 which is adjacent the support structure 12 in the channel 38. Preferably, each folding arm 28, 30 is substantially as wide as the corresponding support flange 32, 34. Each folding arm 28, 30 includes two electrical connections 48 extending from a lower side 50 of the folding arm 28, 30 and located adjacent to an interior edge 52. Other embodiments could include one or more electrical connections, depending on the amount of bulbs needed. Folding arm 28, 30 further includes mounting flange 54 located adjacent to the electrical connections. Each mounting flange 54 includes either an L-shaped extension 56 creating a notch 57 or a connection point 58, which in this preferred embodiment is a screw that is not flush with the mounting flange 54. The extension 56 and connection point 58 are utilized in mounting reflectors 60.

Preferably, the mounting bracket 22 and each folding arm 30 also include a locking mechanism. In this embodiment the locking mechanism includes ramps 62 located near the interior edge 52 of the pivot end 42 of the folding arm 28, 30. The support flanges 32, 34 include corresponding locking holes 64 for receiving the ramps 62 when the folding arms 28, 30 are in a deployed position with the folding arms 28, 30 perpendicular to the support frame 12. In this deployed position, elongate reflectors 60 can be attached.

The elongate reflectors 60 of this embodiment each include two reflector portions 66 for reflecting the light from two bulbs (not shown) on either side of the support frame 12. However, in other embodiments the reflector portions 66 could be two independent reflectors separately attached to the folding arms 28, 30. Elongate reflector 60 includes mounting openings 68 at either end for connection to the extension 56 or connection point 58 of the mounting arms. These mounting openings 68 include a first section 70 sized to allow passage of the extension 56 or connection point 58 and a second section (not visible) sized to fit within the notch 57 or under the screw head of the connection point 58.

In use, the light fixture support assembly 10 has two positions, a stowed position wherein the folding arms 28, 30 are substantially parallel with the support frame 12, and a deployed position wherein the folding arms 28, 30 are substantially perpendicular to the support frame 12. It is most preferred that the reflectors 60 are about as wide as the assembly 10 in the stowed position. With such a matching width the assembly and reflectors can be packaged together in a manner that minimizes the potential for breakage during shipment. When the assembly 10 is in the location to be installed the folding arms 28, 30 can then be moved into the deployed position. When the arms 28, 30 are rotated into the deployed position the arms 28, 30 move up the ramps 62 until the ramps 62 are entirely under the locking holes 64; at which time the arms 28, 30 press down over the ramps 62 and are locked into the deployed position. The reflectors 60 are then installed by lining up the first section 70 of the mounting openings 68 with the extension 56 or connection point 58. The reflector 60 is then slid so that the second section 72 of the mounting openings come into interference contact with the extension 56 or connection point. The screw of the connection point 58 can then be tighten to hold the reflector 60 in place.

While the principles of the invention have been shown and described in connection with specific embodiments, it is to be understood that such embodiments are by way of example and are not limiting.

The invention claimed is:

1. In a light-fixture assembly for elongate light tubes of the type including (a) an elongate support frame extending between two opposite frame ends and (b) a cross-structure at each of the opposite frame ends and having at least one lamp holder thereon, the improvement wherein the cross-structures each includes at least one folding arm and a mounting bracket, wherein the mounting bracket is attached to the support frame and the folding arm is movably attached to the mounting bracket; the at least one folding arm movable between a deployed position, in which the arm extends away from the support frame substantially perpendicular thereto, and a stowed position, in which the arm extends substantially parallel with the support frame between the opposite frame ends, whereby allowing for a compact packaging of the light fixture.

2. The light fixture assembly of claim 1 further including at least one elongate reflector removably attached to both cross-structures when the cross-structures are in the deployed position.

3. The light fixture assembly of claim 2 wherein each cross-structure includes at least one screw for attaching the elongate reflector and the elongate reflector includes at least one keyhole-type opening for accepting the screw, thereby allowing for removable attachment of the reflector to the cross-structure.

4. The light fixture assembly of claim 2 further including a locking mechanism for locking the folding arms into the stowed position.

5. The light fixture assembly of claim 4 wherein the locking mechanism includes:

a hole defined on the mounting bracket; and a locking ramp extending from the folding arm and disposed and sized to fit within the hole when the folding arm is in the stowed position.

6. The light fixture assembly of claim 2 wherein each cross-structure includes two folding arms, whereby the folding arms of each cross-structure extend from opposite sides of the support frame.

7. The light fixture assembly of claim 6 further including at least one elongate reflector attached to the folding arms extending from each side of the support frame.

8. The light fixture assembly of claim 7 wherein each folding arm includes at least two lamp holders.

9. In a light-fixture assembly for elongate light tubes of the type including an elongate support frame extending between two opposite frame ends, the improvement comprising at least one cross-structure attached to the frame and a mounting bracket, wherein the mounting bracket is attached to the support frame and the folding arm is movably attached to the mounting bracket; and the at least one folding arm having at least one arm movable between a deployed position, in which the arm extends away from the support frame substantially perpendicular thereto, a stowed position, in which the arm extends substantially parallel with the support frame between the opposite frame ends, whereby allowing for a compact packaging of the light fixture.

10. The light fixture assembly of claim 9 further comprising two cross-structures attached to the frame, each cross structure having at least one folding arm and movable between the stowed and deployed positions, wherein the folding arm of each of the two cross-structures is disposed to extend from a first side of the frame.

11. The light fixture assembly of claim 10 wherein the folding arms extending from the cross-structures comprise a first folding arm assembly, the improvement further including a second folding arm assembly attached to cross-structures wherein the folding arms of the second folding arm assembly are disposed to extend from a second side of the frame.

12. The light fixture assembly of claim 11 wherein the cross-structures are disposed at the opposite ends of the elongate support frame.

13. The light fixture assembly of claim 12 further comprising a plurality of reflectors attached to each of the folding arm assemblies.

14. A method of utilizing a light fixture assembly, comprising:

providing an elongate light fixture support assembly having a width and a length between two opposite frame ends;

providing a pair of cross-structures each attached to one of the opposite frame ends, the cross-structures each having at least one lamp holder, at least one folding arm, and a mounting bracket, wherein the mounting bracket is attached to the support assembly and the folding arm is movably attached to the mounting bracket; the at least one folding arm movable between a stowed position in which the arm extends substantially parallel with the support assembly between the opposite frame ends and a deployed position in which the arm extends away from the support assembly perpendicular to the support assembly;

packaging the support assembly such that the arms extend substantially parallel with the support assembly along the length of the support assembly between the two opposite frame ends shipping the light fixture to a location where it is to be installed; and deploying the cross-structures whereby the lamp holders are positioned to receive an elongate light bulb and the at least one folding arm is moved into the deployed position in which the arm extends away from the support assembly.

15. The method of claim 14 further including:

prior to the step of packaging, providing at least one elongate reflector;

the step of packaging also including packaging the reflector together with the support assembly and the cross-structure such that the cross-structure and at least one reflector extend away from the support assembly for less than one-half of the width of the support assembly; and after the step of deploying the cross-structures, attaching the at least one reflector to the folding arms of the cross-structures.

* * * * *